US005551362A

United States Patent [19]

Migliorini

[11] Patent Number: 5,551,362

[45] Date of Patent: Sep. 3, 1996

[54] AUTOMATICALLY SEAMING TWO STOCKINGS TO FORM A PANTYHOSE ARTICLE

[75] Inventor: Pier L. Migliorini, Terranuova Bracciolini Arezzo, Italy

[73] Assignee: Solis S.R.L., Tavarnuzze, Italy

[21] Appl. No.: 219,021

[22] Filed: Mar. 28, 1994

[30] Foreign Application Priority Data

Apr. 1, 1993 [IT] Italy ..... FI93A0066

[51] Int. Cl.[6] ..... D05B 21/00

[52] U.S. Cl. ..... 112/475.12; 112/470.15

[58] Field of Search ..... 112/706, 312, 112/470.07, 470.08, 470.15, 470.18, 475.12; 223/75, 77

[56] References Cited

U.S. PATENT DOCUMENTS 3,777,681 12/1973 Horita ..... 112/475.15 X 4,541,351 9/1985 Horita et al. ..... 112/470.15

4,862,815 9/1989 Thurner et al. ..... 112/475.12

FOREIGN PATENT DOCUMENTS

FI/91/A/232 9/1991 Italy .

*Primary Examiner*—Ismael Izaguirre

*Attorney, Agent, or Firm*—McGlew and Tuttle, P.C.

[57] ABSTRACT

Machine for automatically seaming two stockings to form a pantyhose article, including a plurality of flat, paired shapes, supporting each pair of stockings to be joined, a device for positioning and moving the stockings on the relevant shapes, a device for longitudinally cutting the stockings bodices, wherein the shapes are individually supported by corresponding shape-holder pallets so as to allow them to be moved separately and at different speeds, wherein an automatic stationary seamer is provided at the stockings-seaming station so as to make a single seam, that is, a continuous seam for sewing the aligned edges of the bodices thus cut, and wherein devices are provided for driving each pallet into motion, at a differentiated speed, in correspondence of the seaming station, with respect to the others.

15 Claims, 4 Drawing Sheets

AUTOMATICALLY SEAMING TWO STOCKINGS TO FORM A PANTYHOSE ARTICLE

FIELD OF THE INVENTION

The present invention refers to a method and a machine for automatically seaming two stockings to form a pantyhose article.

BACKGROUND OF THE INVENTION

Known from the Italian patent FI 91 A 232 of the same owner is a machine for automatically seaming two stockings to form a pantyhose article, which comprises: carrousel means horizontally rotating with intermittence and provided with a plurality of flat, paired shapes for the support of the stockings, which shapes are solid between them, jointly driven into motion by a corresponding support member, and fixed with respect to the stockings-seaming means during each operating phase; means for positioning and moving the stockings fitted on the relevant support shapes; means for longitudinally cutting the stockings bodices; means for sewing the two-by-two aligned edges of the thus cut bodices of the two stockings by means of two movable sewing machines, each of which carries out the junction of a corresponding pair of fabric edges.

However, it is known by experience that, as the seam is carried out in two lengths, which result in a partial overlapping in an area of the perineal region of the bodice, the finished pantyhose article takes up a scarcely agreeable aspect. Besides, the use of two seamers brings about a rise in the manufacturing and running costs of these known machines when considering that the cost of each seamer is considerable with respect to the whole cost of the machine.

SUMMARY AND OBJECTS OF THE INVENTION

The main object of the present invention is to overcome the above drawbacks and to provide a method and a machine for the formation of pantyhose articles, which allow the cut edges of the stockings to be joined by a single seam and at the same time, the manufacturing and running costs of the machine to be significantly reduced, while maintaining the same high production capacity.

This result has been achieved, according to the present invention, by adopting a method for the automatic seaming of two pantyhose-forming stockings, comprising the steps of: fitting and positioning the two stockings on corresponding paired support shapes; carrying out the longitudinal cut of the bodices of the thus positioned stockings over an equal length; stretching apart the shapes with the thus cut bodices of the stockings; seaming of the fabric edges projecting from the thus stretched apart shapes. Wherein the seam is a single one, that is, it is made continuously for the two pairs of fabric edges throughout the seaming phase and with the corresponding shapes being driven onto a relative feeding motion at constant and continuous speed. The present invention also allows that one or more of the above steps which precedes the seaming step, are carried out with the support shapes being stopped to allow the corresponding operating means to act.

As far as the implementation of the method is concerned, a circular carrousel-type machine is used, with a plurality of flat, paired shapes for supporting each pair of stockings to be united, with means for positioning and moving the stockings onto the respective shapes, with means for longitudinally cutting the bodices, wherein the shapes are individually carried by corresponding shape-holder pallets so as to allow them to be separately moved at different speeds, wherein an automatic stationary seamer is provided in correspondence of the stockings-seaming station, so as to carry out a single seaming, that is, a continuously seaming of the two fabric edges of the thus cot bodices, and wherein means are provided for moving each pallet at a differentiated speed, in correspondence of the sewing station, with respect to all the others.

The advantages derived from the present invention lie essentially in that it is possible to carry out a single and continuous seaming of the aligned edges of the bodices of the two stockings to be joined, while ensuring a high production capacity and conferring the pantyhose an acceptable and desirable exterior aspect; that it is possible to reduce significantly the manufacturing cost of a pantyhose-forming machine having the same production capacity, thanks to the elimination of a seamer; that a machine according to the invention is highly reliable even after a prolonged service life.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1:
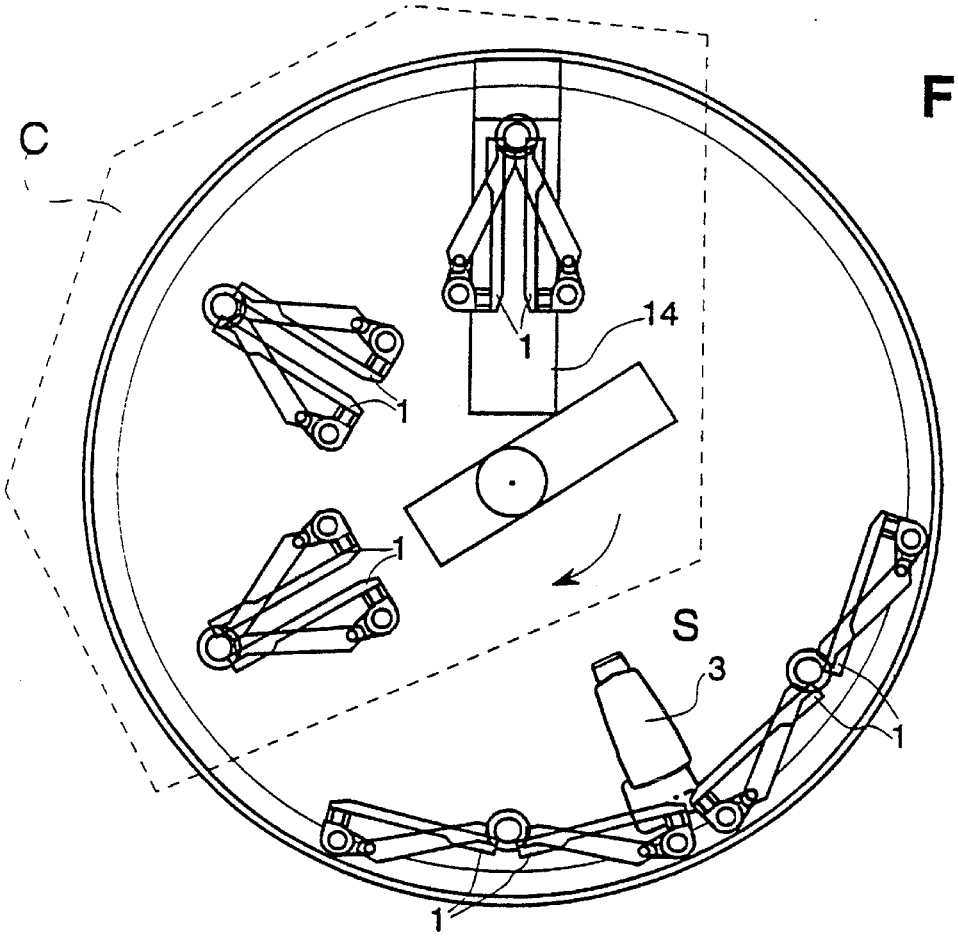
FIG. 1 shows schematically the plan view of a pantyhose-forming machine according to the invention.

Reduced to its basic structure,and reference being made to the accompanying drawings, an operating method for automatically seaming two stockings to form a pantyhose article, comprising the steps of:

a) fitting and positioning the two stockings on corresponding paired shapes 1;

b) carrying out the longitudinal cut of an equal length of the bodices of the thus positioned stockings;

c) spreading apart the shapes 1 with the thus cut stockings bodices thereon;

d) carrying out the seaming of the fabric edges projecting from the thus spread apart shapes 1. This step, according to the invention, implies that the seaming is a single one, that is, it is made continuously for the two pairs of fabric edges and with the corresponding shapes 1 being driven into a relative feeding motion at constant and continuous speed, and wherein one or more of the above steps (a,b,c) which come before the seaming step (d), are carried out with the support shapes 1 being stopped to allow the corresponding operating means (that is, for the loading, positioning, cutting, etc.) to act.

In other words, during one or more of the steps (a,b,c), one or more of the supports of shapes 1 may be stationary while all the others are in motion.

Thus, for example, when considering the case of five supports for as many shapes 1, during the seaming step (d), two shapes 1 with the relevant supports may be stationary with respect to the corresponding operating means, and the other three shapes in motion. It will be appreciated that, in correspondence of the stationery shapes 1, provision is made for the relevant stockings-working means to move, and vice versa.

As far as the implementation of the method is concerned, a circular carrousel-type machine is provided having five flat, paired shapes 1 for supporting each pair of stockings to be joined. A loading station C is provided and includes positioning means for positioning and moving the stockings onto the respective shapes, with cutting means 14 for longitudinally cutting the bodices. According to the invention, the shapes 1 are individually carried by corresponding shape-holder pallets 2 so as to allow them to be separately moved at different speeds. An automatic stationary seamer 3 is provided in correspondence with the stockings-seaming station S, so as to carry out the single seaming, that is a continuous seaming of the two fabric edges of the thus cut bodices. Means are provided for moving each pallet 2 at a differentiated speed, in correspondence of the sewing station S, with respect to all the others.

Figure 2:
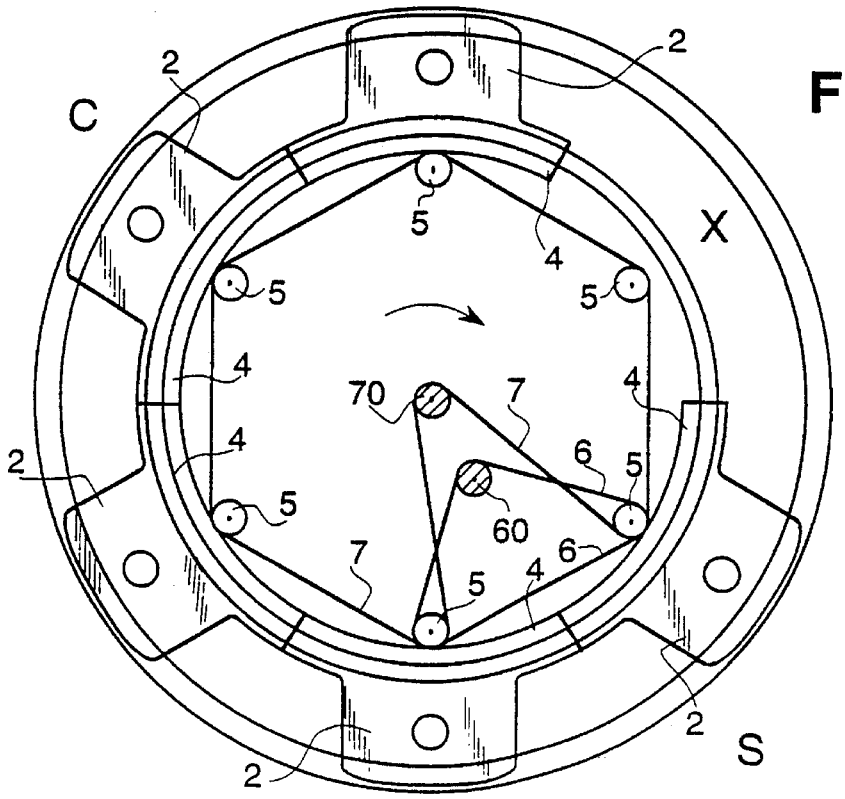
FIG. 2 shows schematically the means for moving the shape-holder pallets of the machine of FIG. 1, according to a first embodiment of the invention.

More in particular, and with reference to FIG. 2 of the accompanying drawings, the means for moving the pallets 2 comprise a sector gear 4, in correspondence of the base of each pallet 2. The sector gear 2 is shaped as a circular arc with the concavity turned inwardly of the machine and is engaged with a corresponding pinion 5. Pinions 5 are disposed at the vertexes of a regular hexagon inside the machine, and the distance between the two contiguous or adjacent pinions 5 is approximately equal to the chord of the circular arc, so as to allow the pallets 2 to be moved whatever their angular position. Moreover, to allow the pallets 2 to move at a differentiated speed, in correspondence of the seaming station, with respect to the other pallets 2, each pinion 5 is engaged to a corresponding driving motor—not shown for clarity in the drawing—so that the pinion 5 of the seaming station and the one adjacent thereto in the direction of rotation of the carrousel, will rotate at constant and continuous speed. The angular amplitude of each sector gear 4 is a fraction of the round angle, so that a same fraction X will be free or empty, that is, not engaged by any sector 4.

Advantageously, according to the invention and with reference to FIG. 2 of the attached drawings, the means for moving the pallets 2 comprise two closed loop chain drives 6, 7, one chain drive 6 being engaged with a corresponding seam driving motor 60 and intended to move both the pinion 5 in correspondence of the seaming station S and the pinion immediately following it. The other chain drive 7 is engaged to a corresponding group driving motor 70 and intended to move the pinions 5 located away from the seaming station S.

Figure 3:
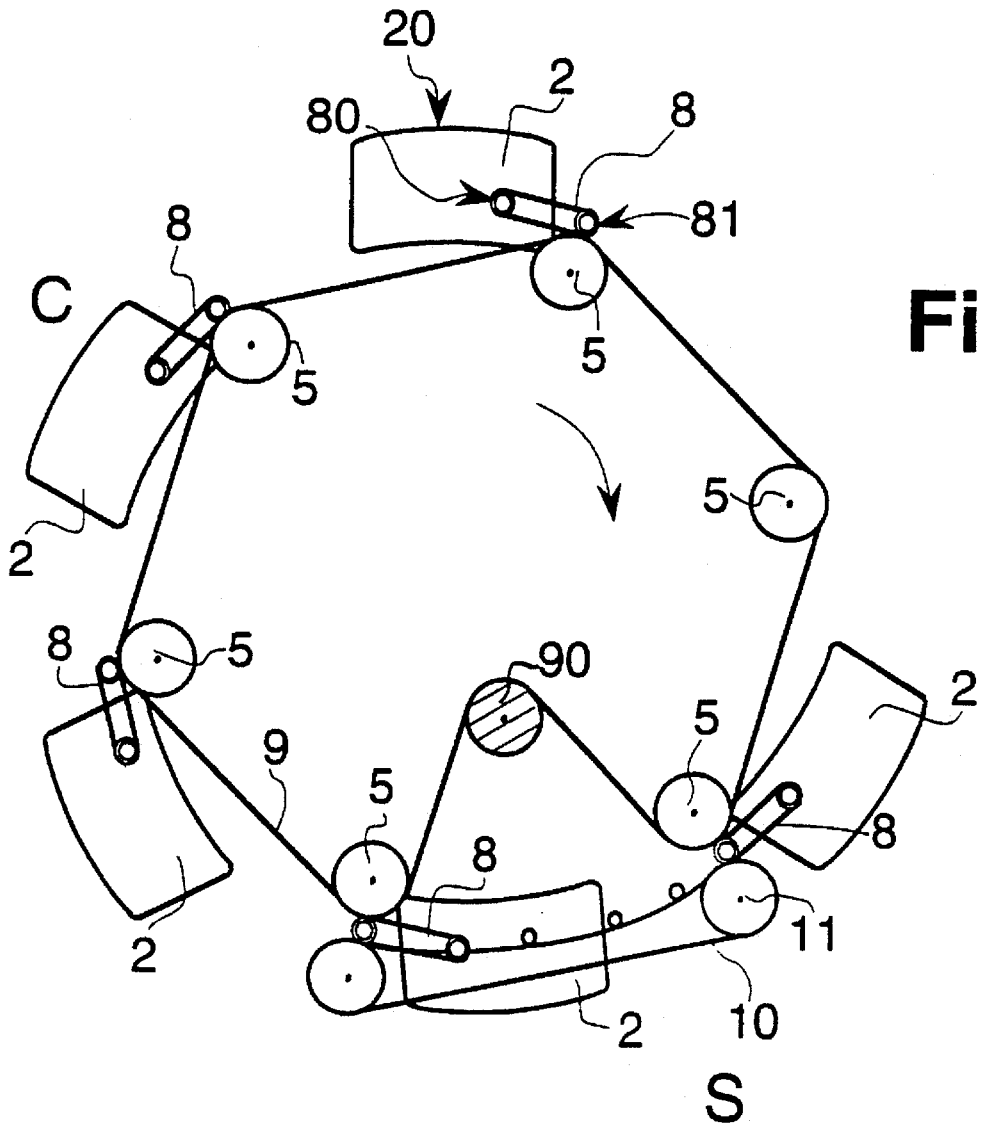
FIG. 3 shows schematically the means for moving the shape-holder pallets of the machine of FIG. 1, according to a second embodiment of the invention.
Figure 4:
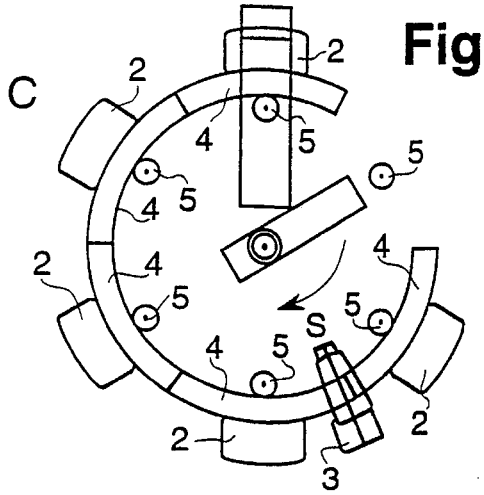
FIG. 4 shows schematically the machine of FIG. 1 in a position in which it begins to seam a pantyhose article.
Figure 5:
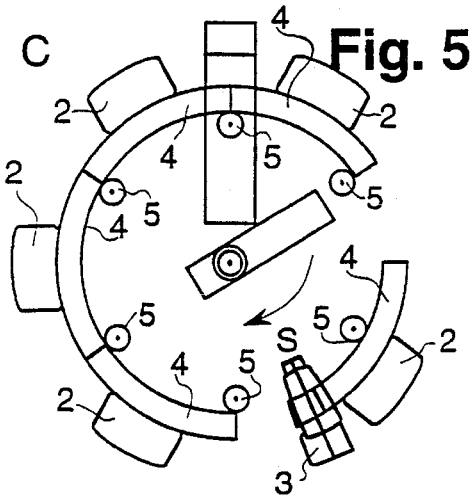
FIG. 5 shows the machine of FIG. 4 in a position to carry on the seaming of the pantyhose article.
Figure 6:
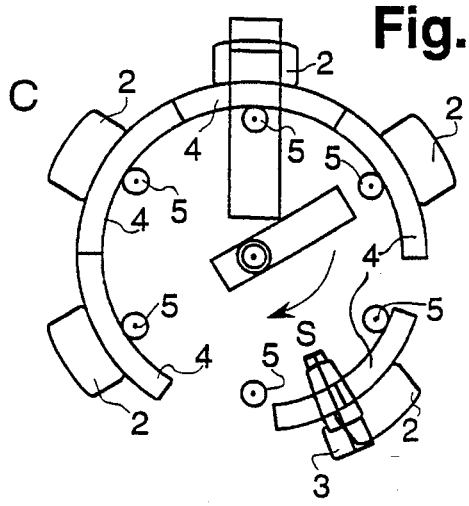
FIG. 6 shows the machine of FIG. 5 in a position to further carry on the seaming of the pantyhose article.
Figure 7:
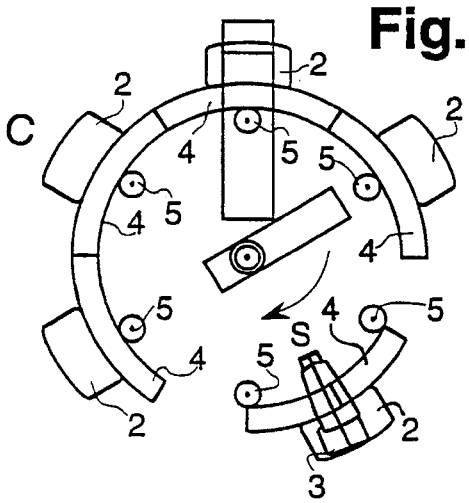
FIG. 7 shows the machine of FIG. 6 in a position to further carry on the seaming of the pantyhose article.
Figure 8:
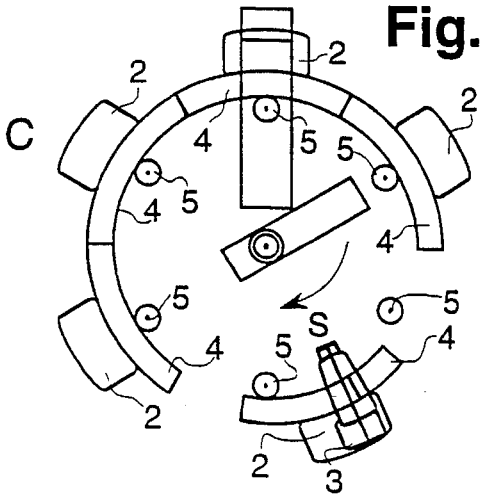
FIG. 8 shows the machine of FIG. 7 in a position to further carry on the seaming of the pantyhose article.
Figure 9:
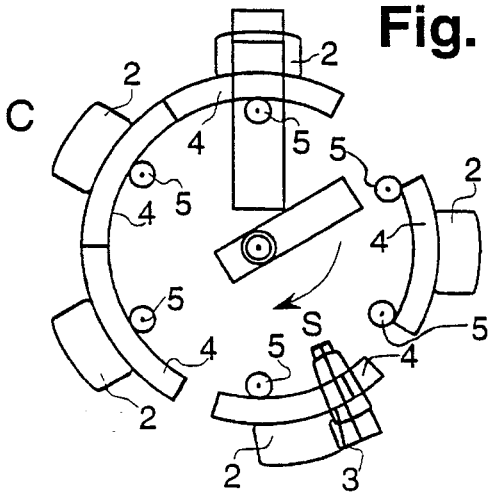
FIG. 9 shows the machine of FIG. 8 in the step of completion of the pantyhose seaming.

Alternatively, reference being made to FIG. 3 of the accompanying drawings, the means for moving the pallets 2 comprise a connecting rod 8 in correspondence with the lower base of each pallet 2. One side 80 of the rod 8 is hinged to the base 20 of the corresponding pallet 2. The other side 81 of the rod 8 is engaged, or hinged, with a drive chain 9 over the length of the drive chain 9 between the loading station C and the seaming station S. The drive chain 9 is moved by a driving motor 90. The other side 81 of the rod 8 is engaged, or hinged, with a drive chain 10 over a length of the drive chain 10 in correspondence with the seaming station S. The drive chain 10 is moved by a driving motor 11 rotating at a speed higher than that of motor 90. In this way, it is possible to move the pallets 2 at a differentiated speed, in correspondence of the seaming station, with respect to the speed of all the other pallets.

Figure 10:
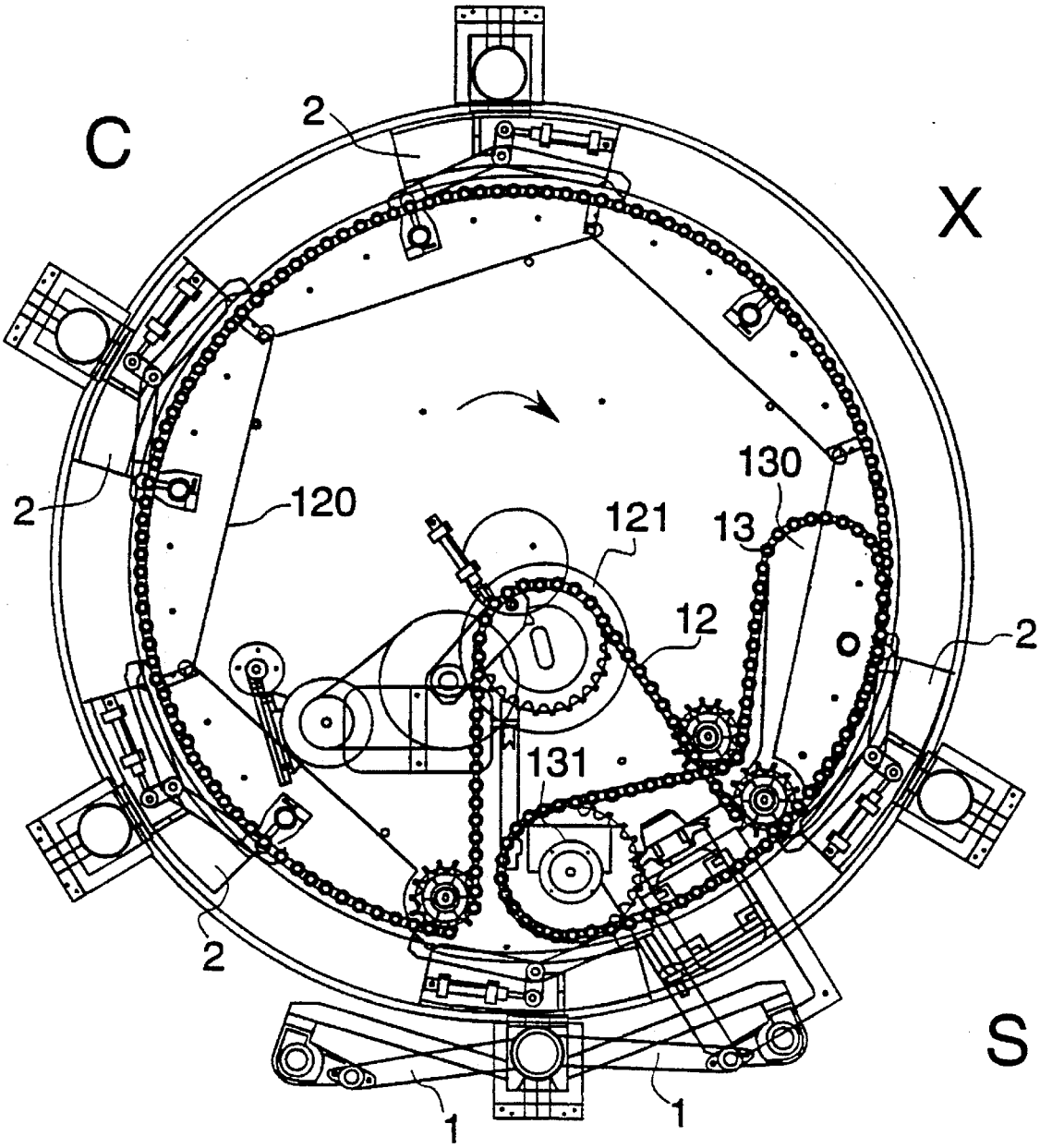
FIG. 10 shows the means for moving the shape-holder pallets of the machine of FIG. 1, according to a further embodiment of the invention.

As a further alternative, reference being made to FIG. 10 of the accompanying drawings, the shape-holder pallets 2 are moved at different speeds. These speeds depend on the instantaneous positions of the respective shape-holder pallets 2. These speeds are caused by means of two distinct driving chains 12, 13 each of which is supported by a corresponding guide element 120, 130 made of plastic material. The drive chain 12 is engaged to a corresponding driving motor 121 and intended to move the pallets 2 of the shapes 1 located outside the seaming station C. The other drive chain 13 is engaged to a corresponding driving motor 131 and intended to move the pallets 2 of the shapes 1 in correspondence with the seaming station C.

Practically, all the construction details may vary in any equivalent way as far as the shape, dimensions, elements disposition and nature of the used materials are concerned, without nevertheless departing from the scope of the adopted solution idea and, thereby, remaining within the limits of the protection granted to the present patent for industrial invention.

We claim:

1. A method for seaming two stockings together, the method comprising the steps of:

providing a plurality of pairs of shapes:

moving said plurality of pairs of shapes to a first station;

cutting a bodice of each of said two stockings on said each pair of shapes;

spreading apart each shape of said each pair of shapes after said cutting;

independently moving said each pair of shapes from said first station to a seaming station;

seaming the two stocking of said each pair of shapes together at said seaming station.

2. A method in accordance with claim 1, further comprising:

moving a set of said plurality of pairs of shapes as group during said positioning, said cutting and said spreading;

moving said each pair of shapes independently of said set during said seaming.

3. A method in accordance with claim 2, wherein:

moving of said each pair of shapes during said seaming is at a speed different than a speed of moving of said set of plurality of pairs of shapes.

4. A method in accordance with claim 2, wherein:

moving said each pair of shapes during said seaming in a sequence of movements that is different than a sequence of movements for said set of pairs of shapes.

5. An apparatus for seaming two stockings together, the apparatus comprising:

a plurality of pairs of shapes for mounting stockings thereon;

cutting means for cutting a bodice of the stockings on each pair of shapes;

spreading means for spreading apart each shape of said each pair of shapes after cutting of the bodices seaming means for seaming the two stockings of said each pair of shapes together;

seam driving means for independently moving said each pair of shapes past said seaming means.

6. An apparatus in accordance with claim 5, further comprising:

positioning means for positioning two stockings on each pair of shapes.

7. An apparatus in accordance with claim 5, further comprising:

a loading station for loading stockings onto said each pair of shapes.

8. An apparatus in accordance with claim 5, further comprising:

positioning means for positioning two stockings on each pair of shapes;

a loading station for loading stockings onto said each pair of shapes;

group driving means for moving a set of said plurality of pairs of shapes as a group past said loading station, said cutting means and during operation of said positioning means and said spreading means.

9. An apparatus in accordance with claim 5, further comprising:

group driving means for moving a set of said plurality of pairs of shapes as a group past said cutting means and during operation of said spreading means.

10. An apparatus according to claim 9, wherein:

said seam driving means and said group driving means include a sector gear positioned on a base of said each pair of shapes, each sector gear having a profile shaped as an arc with a concavity of said arc turned inwardly of the apparatus, said seam driving means and said group driving means also including a plurality of pinions engagable with said each sector gear, said pinions being positioned in a substantially hexagonal pattern, distances between two adjacent pinions being approximately equal to a chord of said arc, so as to allow said each pair of shapes to be moved regardless of their angular position.

11. An apparatus in accordance with claim 10, wherein:

one of said pin and another one of said pinions are connected to said seam driving motor by a chain drive;

remaining said pinions being connected to a group motor by another chain drive.

12. An apparatus in accordance with claim 9, wherein:

said each sector gear is positioned substantially along a circle, said each sector gear has an angular length, said plurality of pairs of shapes being a number and said angular length being a magnitude to cause said circle to have a portion free of said sector gears, said portion of said circle being substantially similar in magnitude to said angular length.

13. An apparatus in accordance with claim 9, wherein:

said each pair of shapes is mounted on an individual pallet;

said seam driving means includes a seam driving motor and a seam drive chain;

said group driving means including a group driving motor and a group drive chain;

said seam driving means and said group driving means include a plurality of connecting rods, each of said plurality of connecting rods having a first end pivotally connected to a different one of said pallets, said plurality of connecting rods having a second end connectable to said seam drive chain and said group drive chain.

14. An apparatus in accordance with claim 9, wherein:

said each pair of shapes is mounted on an individual pallet;

said seam driving means including a seam driving motor and a seam drive chain;

said group driving means including a group driving motor and a group drive chain;

said seam driving means and said group driving means include a guide means for engaging with said seam drive chain and said group drive chain.

15. An apparatus in accordance with claim 14, wherein:

said guide means is formed of plastic.

* * * * *

UNITED STATES PATENT AND TRADEMARK OFFICE

CERTIFICATE OF CORRECTION

PATENT NO. : 5,551,362
DATED : September 3, 1996
INVENTOR(S) : MIGLIORINI

It is certified that error appears in the above-indentified patent and that said Letters Patent is hereby corrected as shown below:

Title page, item [75] correct the inventor's name to read

Pier Lorenzo MIGLIORNI

Signed and Sealed this

First Day of April, 1997

*Attest:*

*Attesting Officer*

BRUCE LEHMAN

*Commissioner of Patents and Trademarks*